United States Patent [19]

Flanagan

[11] Patent Number: 5,069,237

[45] Date of Patent: Dec. 3, 1991

[54] DISPOSABLE UMBRELLA

[76] Inventor: Michael L. Flanagan, 921 American Beauty Street, Orlando, Fla. 32818

[21] Appl. No.: 677,311

[22] Filed: Mar. 29, 1991

Related U.S. Application Data

[63] Continuation-in-part of Ser. No. 482,636, Feb. 21, 1990, abandoned.

[51] Int. Cl.[5] ..... A45B 13/00

[52] U.S. Cl. ..... 135/19.5; 135/39; 135/43

[58] Field of Search ..... 135/19.5, 25.4, 28, 135/29, 38, 39, 43, 19, 37

[56] References Cited

U.S. PATENT DOCUMENTS

| | | | |
|---|---|---|---|
| 171,802 | 1/1876 | Hatch | 135/43 |
| 291,090 | 1/1884 | Saxe | 135/43 |
| 355,142 | 12/1886 | Crabtree | 135/43 |
| 737,787 | 9/1903 | Shepherd | 135/43 |
| 1,096,216 | 5/1914 | Beehler | 135/334 |
| 1,145,285 | 7/1915 | Williamson | 135/29 X |
| 1,255,182 | 2/1918 | Krupski | 135/25.4 X |
| 3,177,882 | 4/1965 | Militano | 135/28 X |
| 3,424,180 | 1/1969 | Andofi | 135/28 X |
| 3,921,655 | 11/1975 | Weber | 135/28 X |
| 4,033,366 | 7/1977 | Forget | 135/33.4 |
| 4,567,907 | 2/1986 | Dubinsky | 135/28 X |
| 4,821,756 | 4/1989 | England | 135/19.5 |
| 5,020,557 | 6/1991 | Apple | 135/28 X |

FOREIGN PATENT DOCUMENTS

| | | |
|---|---|---|
| 393653 | 12/1908 | France . |
| 24376 | 1/1910 | Sweden . |
| 24564 | of 1911 | United Kingdom . |

*Primary Examiner*—Richard E. Chilcot, Jr.
*Assistant Examiner*—Lan Mai
*Attorney, Agent, or Firm*—William M. Hobby, III

[57] ABSTRACT

A disposable umbrella apparatus is made of thermoplastic and inexpensive materials and has a central staff made of a length of plastic pipe. Three short plastic dowels are mounted perpendicular through the staff and a plastic cap mounts to the top of the pipe to act as a stop for a fixed upper collar supporting the fixed struts of the umbrella and as a latch for a slidable collar carrying the collapsing umbrella struts. The slidable collar has an opening therethrough and slides along the staff pipe and the latching for the umbrella uses a pair of grooves along the inside of the opening the slidable collar so that the collar can slide over one of the plastic dowels protruding from the staff and abut against a second dowel protruding from the staff and then rotated between the two dowels to latch the collars and struts in position to hold the umbrella in an open position. The collar is thus rotated to misalign the grooves with respect to the dowel on either side thereof to prevent movement past the dowels in either direction. The waterproof covering for the umbrella may be thermoplastic sheet heat sealed in place on the struts.

6 Claims, 1 Drawing Sheet

DISPOSABLE UMBRELLA

INFORMATION DISCLOSURE STATEMENT

This application is a continuation-in-part of prior U.S. patent application Ser. No. 482,636, filed Feb. 21, 1990 for Disposable Umbrella.

Umbrellas have long been known, and numerous specific mechanisms exist to provide for the opening and closing of umbrellas. Traditionally, umbrellas are relatively permanent or long-lasting devices that are relatively expensive. The usual mechanisms of umbrellas comprise metal struts and catches with riveted joints. More recently, umbrellas have become even more complex and expensive because of the development of the self-opening or self-closing umbrellas wherein a spring is compressed and used for the automatic action of the umbrella.

For the present day mobile society, it is frequently found that a person's umbrella is not where it is needed. For example, one may attend the theater and find it is raining at the time to leave, and the person's umbrellas may be in the car or at home. Similarly, one may be at home and require an umbrella to reach the car and the umbrella is in the car. Because of the complexity of umbrellas, and the consequent cost, one person will generally not have enough umbrellas to place everywhere desired. Also the cost of umbrellas usually inhibits the purchase of an umbrella anytime an umbrella is needed.

SUMMARY OF THE INVENTION

This invention relates generally to umbrellas, and is more particularly concerned with an umbrella having very simple construction and inexpensive parts so the umbrella can be treated as disposable.

A disposable umbrella apparatus is made of thermoplastic and inexpensive materials and has a central staff made of a length of plastic pipe. Three short plastic dowels are mounted perpendicular through the staff and a plastic cap mounts to the top of the pipe to act as a stop for a fixed upper collar supporting the fixed struts of the umbrella and as a latch for a slidable collar carrying the collapsing umbrella struts. The slidable collar has an opening therethrough and slides along the staff pipe and the latching for the umbrella uses a pair of grooves along the inside of the opening the slidable collar so that the collar can slide over one of the plastic dowels protruding from the staff and abut against a second dowel protruding from the staff and then rotated between the two dowels to latch the collars and struts in position to hold the umbrella in an open position. The collar is thus rotated to misalign the grooves with respect to the dowel on either side thereof to prevent movement past the dowels in either direction. The waterproof covering for the umbrella may be thermoplastic sheet heat sealed in place on the struts.

The present invention provides an umbrella largely formed from existing components that are easily modifiable to produce parts for the umbrella. Some of the parts are of custom design but these parts can be made of plastic or the like and subject to inexpensive mass production techniques. The assembly of the umbrella of the present invention is quick and simple, pivoted parts being assembled through the use of plastic dowel pins. The main shaft of the umbrella may be a length of conventional, readily available pipe or tubing with conventional fittings to complete the staff. A plastic film may be used as the waterproof covering readily attached in place on the struts of the umbrella.

BRIEF DESCRIPTION OF THE DRAWINGS

These and other features and advantages of the present invention will be apparent from consideration of the following specification when taken in conjunction with the accompanying drawings in which.

DETAILED DESCRIPTION OF THE EMBODIMENTS

Figure 1:
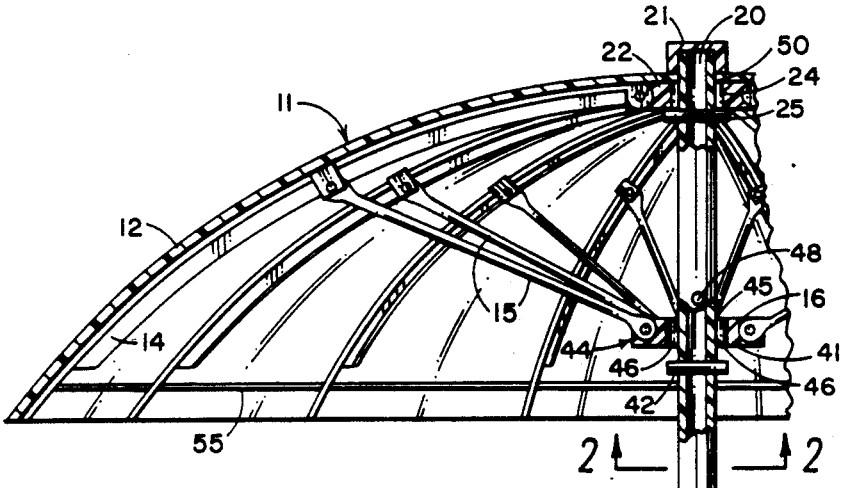
FIG. 1 is a partial longitudinal cross-sectional view of an umbrella made in accordance with the present invention.

Referring now more particularly to the drawings and to that embodiment of the invention here presented by way of illustration, the umbrella shown in FIG. 1 includes a main staff 10 having a canopy 11 mounted at one end thereof. The canopy 11 includes a waterproof film 12 supported by a plurality of main struts 14, the main struts 14 extending from the periphery of the film 12 to the staff 10. The main struts 14 are pivoted at the staff 10, and are held in the position shown by a plurality of collapsing struts 15. The collapsing struts 15 have one end pivotally fixed to the main struts 14 and the opposite end connected to a selectively slidable collar 16, the collar 16 being slidable along the staff 10.

It will be recognized by those skilled in the art that the above description generally covers any conventional umbrella. The novel features of the present invention reside in the particular construction of the above described parts of the umbrella.

Looking further at FIG. 1 of the drawings, it will be observed that the staff 10 of the umbrella is a simple tube and may be formed of a piece of conventional pipe, such as polyvinyl chloride (PVC) pipe. The lower end 18 of the pipe is closed by an ordinary cap 19 which can be glued in place as is well known. The upper end 20 may similarly be closed by a cap 21.

The main struts 14 of the umbrella have their inner ends pivotally fixed to a collar 22. The collar 22 defines a central opening 24 for receiving the staff 10, and the collar is held against downward movement by a plastic dowel pin 25. Many other techniques may be utilized to limit the motion of the collar 22 but the pin 25 may comprise a small PVC dowel inserted perpendicular through an appropriate hole through the pipe constituting the staff 10. Thus, the pin 25 limits motion of the collar 22 in one direction and the cap 21 limits motion in the opposite direction.

Figure 5:
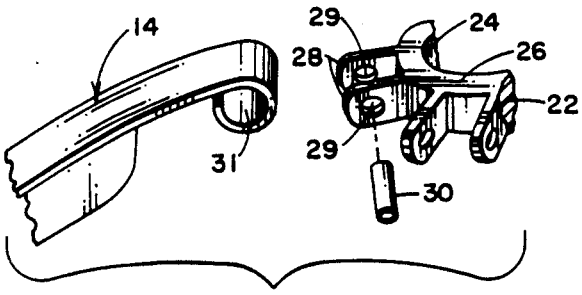
FIG. 5 is an exploded, perspective view showing the connection of the main struts with the staff in the embodiment of FIG. 1.

The construction of the collar 22 and the connection of the main struts 14 thereto are shown in more detail in FIG. 5 of the drawings. The collar 22 includes an annulus 26 having a plurality of generally radially extending tabs 28. The tabs 28 have holes 29 therethrough for receiving pins, such as the pin 30. It will therefore be understood that a pair of tabs 28 receive a pin 30 through aligned holes 29 to form a clevis arrangement with the pin 30 as the clevis pin.

The inner ends of the main struts 14 are formed with an eye 31. The inner end of a strut 14 will therefore be received between two of the tabs 28 with the eye 31 aligned with the holes 29. The pin 30 can then be passed through the hole 29 to provide a secure pivot for the main strut 14. Each of the struts 14 will of course be formed similarly and the description does not need to be repeated for the remaining struts.

Figure 4:
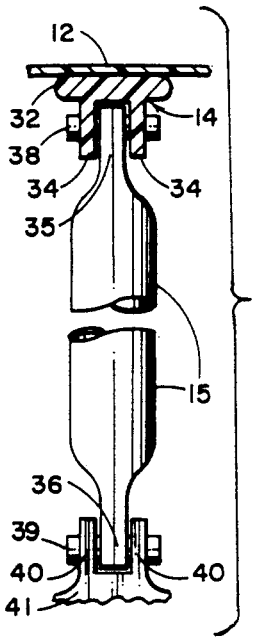
FIG. 4 is a fragmentary elevation showing one collapsing strut and its connections in the embodiment of FIG. 1.

The struts 14 may be manufactured in many ways and may be made of a plastic such as polyethylene or may be made of steel or other metal as desired. The cross-sectional shape of the struts 14 is shown in FIG. 4 and the struts 14 have a rib 32 for receiving the film 12. A pair of perpendicular ribs 34 is formed integrally with the rib 32 both to provide strength and to allow easy connection of the collapsing struts 15.

If the strut 14 is extruded, the cross-sectional shape just described will of course extend throughout the length of the strut. Before assembly then, the ribs 34 must be removed at each end. At the inner end, the ribs 34 will be cut away or otherwise removed and the rib 32 will be heated and rolled to form the eye 31. The outer end of the strut 14 will similarly have the ribs 34 removed to leave the rib 32 and the film 12 will be wrapped around the outer end of the rib 32.

While extrusion constitutes an inexpensive means for forming the main struts 14, it is obvious that the main struts 14 may be formed by injection molding, or using conventional steel wire shaped on a jig. With the construction of the main struts 14 in mind, attention is directed to FIG. 4 of the drawings which shows the construction of the collapsing struts 15. Each strut 15 is formed from a piece of tubing which may be a thermoplastic or steel tubing. Such tubing is readily available and can be easily cut to the required lengths. Then, each end of the tubing can be flattened as indicated at 35 and 36. The flattened ends 35 and 36 are then punched or drilled to receive the pivot pins 38 and 39.

The end 35 of the strut is received between the ribs 34 and pivoted thereto by the pin 38. The end 36 of the strut 15 is received between tabs 40 extending from a collar 41 and pivoted thereto by the pin 39.

With the above description in mind, it will be realized that the collar 22 is fixed with respect to the staff 10 and the collar 41 is selectively slidable with respect to the staff 10. When the collar 41 moves up with respect to the staff 10, the collapsing struts 15 cause the main struts 14 to pivot outwardly to open the canopy 11. When the collar 41 moves down, the collapsing struts 15 pull the main struts 14 down to collapse the canopy 11. Thus, it is required to have a means for selectively latching the collar 41 in position in order to hold the canopy 11 in its open position.

Figure 3:
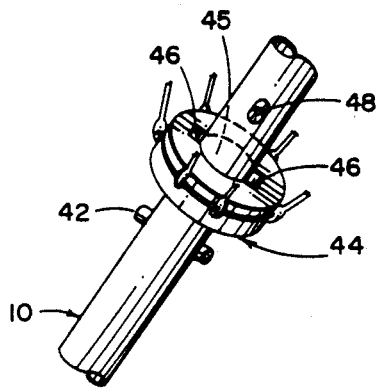
FIG. 3 is a cut-away perspective view showing the latching mechanism used in the embodiment of FIG. 1.
Figure 2:
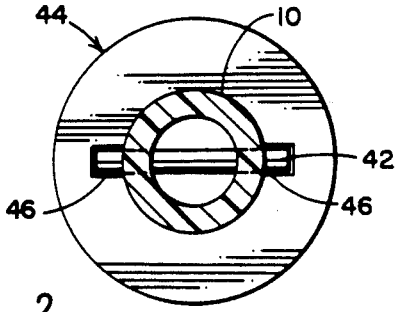
FIG. 2 is an enlarged cross-sectional view taken along the line 2—2 in FIG. 1.

The latching means for the collar 41 is shown in FIGS. 1, 2 and 3. It will be understood that the latching means must be reasonably secure so the canopy 11 will not inadvertently collapse; however, the latching means must be simple and inexpensive for the umbrella to be considered as disposable. The latching means therefore includes a latch pin 42 which may be a PVC dowel extending transversely through the staff pipe 10. Cooperating with the latch pin 42 is a latching sliding collar 44. The latching collar 44 has a central bore 45 which slidably receives the staff 10. On the inside wall of the bore 45 are a pair of grooves 46 positioned 180 degrees apart. A stop pin 48 is also a plastic dowel pin extending perpendicular to the staff 10 through a aperture therethrough and extending from either side of the staff 10 on either side thereof. The latching pin 48 may be longer than the latching pin 42 so that the collar 44 grooves 46 will slide over the latching pin 42 but not over the latching pin 48. As is best shown in FIGS. 1 and 2, the latch pin 42 is sized to be received in the grooves 46 and allow easy, sliding movement of the latching member 44 over the latching pin 42.

The latching member 44 can be rotated in either direction relative to the latching pin 42 once the collar 44 has been slide thereover to thereby latch the collar between dowel pins 42 and 48.

Finally, considering the film 12, it is contemplated that the film 12 will be formed of a polyethylene or other plastic sheet material. Since polyethylene is quite elastic, the film 12 can be laid out as a frustoconical piece, and the elasticity will allow the web to conform to the shape of a segment of a sphere as illustrated.

The central portion, or apex, of the film 12 has an opening 50 therethrough for receiving the staff 10. As is illustrated in FIG. 1, the opening 50 will be small enough that there is no appreciable leakage through the opening 50. The cap 21 may cover the opening, or the web 12 may be sealed or glued to the staff 10.

Figure 6:
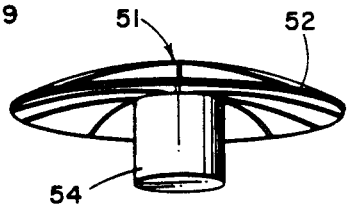
FIG. 6 is a perspective view showing a modified form of cap piece for the umbrella staff.

Alternatively, to prevent leakage around the staff 10 at the opening 40, the cap shown in FIG. 6 may be substituted for the cap 21. The cap 51 of FIG. 6 comprises a dome 52 having a central depending plug 54 The plug 54 is sized to be received within the end of the staff 10 where it can be fixed by glue or the like. The dome 52 then extends radially outwardly enough to assure that water will not run down the staff 10.

The outer edges of the film 12 can be simply folded around the outer ends of the main struts 14. Between the struts 14, the film 12 can be sealed to the struts 14 but this is probably not necessary and would be more difficult than the seals 55.

It will therefore be understood that the present invention provides an umbrella formed largely from stock materials, the materials being thermoplastic for simple heat seals or the like. All assembly details are simple to perform using conventional materials so the entire umbrella can be made very inexpensively. The umbrella will therefore cost little enough that it can be treated as disposable. Furthermore, because the materials are mostly thermoplastic and steel, the discarded umbrellas can be easily recycled.

It will of course by understood by those skilled in the art that the particular embodiment of the invention here presented is by way of illustration only and is meant to be in no way restrictive; therefore, numerous changes and modifications may be made, and the full use of equivalents resorted to, without departing from the spirit or scope of the invention as outlined in the appended claims.

I claim:

1. An umbrella comprising:

a staff;

a fixed collar mounted to one end of said staff;

a plurality of main struts attached to said fixed collar and extending radially from said fixed collar, said plurality of main struts being movable from a collapsed position wherein said main struts extend generally parallel to said staff to an open position wherein said main struts extend outwardly from said staff;

a waterproof film fixed to said plurality of main struts and extending generally from said staff to the extending ends of said main struts;

a slidable collar having a bore therethrough and being slidably mounted to said staff;

a plurality of collapsing struts, said collapsing struts having an inner end pivoted to said slidable collar and an outer end pivoted to said main struts so that movement of said collar slidable along said staff towards said upper end of said staff causes said main struts to move out to an open position; and latching means for selectively holding said slidable collar in a predetermined position on said staff to thereby hold said main struts in said open position, said latching means including a pair of pins mounted through said staff and substantially perpendicular to said staff in a predetermined spaced relationship to each other and said latching means also including said slidable collar having a pair of grooves along said bore walls parallel to the axis of said staff and each groove being spaced about 180 degrees from the other and each groove sized to fit over one said pin extending from said staff, and to be stopped by the other said latching pin on said staff, whereby said slidable collar can slide along said staff past said one said latch pin while being blocked by a second said latch pin and rotated to prevent said latching collar from sliding past said one latch pin.

2. An umbrella as claimed in claim 1, said latching means pair of latching pins attached to said staff includes one latching pin longer than the other to thereby prevent said slidable collar from sliding past the longer latching pin and to thereby latch said collar between said latching pins.

3. An umbrella as claimed in claim 1, said staff includes a pipe of thermoplastic material, said pipe of thermoplastic material having a plurality of apertures passing therethrough sized for dowel pins of predetermined size to fit therethrough to form said latch pins.

4. An umbrella as claimed in claim 3, and further including a top fitted cap attached to the upper end of said staff, said cap being made of a thermoplastic material.

5. An umbrella as claimed in claim 4, and further including a bottom fitted cap attached to the lower end of said staff, said bottom cap being made of a thermoplastic material.

6. An umbrella as claimed in claim 1, in which said fixed collar is held between said top cap on one side thereof and a lock pin attached transversely through said staff on the other side thereof.

* * * * *